US005735493A

United States Patent [19]

Ditch

[11] Patent Number: 5,735,493

[45] Date of Patent: Apr. 7, 1998

[54] ADAPTOR MOUNTING BRACKET FOR CLOCKS

[75] Inventor: Kevin J. Ditch, Melville, Mo.

[73] Assignee: American Trading and Production Corporation, Baltimore, Md.

[21] Appl. No.: 429,958

[22] Filed: Apr. 27, 1995

[51] Int. Cl.[6] ..... G12B 9/00

[52] U.S. Cl. ..... 248/27.1; 248/115; 248/558; 248/909; 368/316

[58] Field of Search ..... 248/27.1, 27.3, 248/114, 115, 201, 300, 909, 558; 368/316, 317

[56] References Cited

U.S. PATENT DOCUMENTS

| | | | |
|---|---|---|---|
| 1,639,598 | 8/1927 | Edelmann | 248/114 |
| 2,651,908 | 9/1953 | Fargo | 368/316 |
| 2,661,173 | 12/1953 | Walser | 248/27.1 |
| 3,026,072 | 3/1962 | Hughes | 248/27.1 |
| 3,716,671 | 2/1973 | Karr | 248/27.1 |
| 4,032,725 | 6/1977 | McGee | 248/27.1 |
| 4,079,838 | 3/1978 | Granum | 248/909 |

*Primary Examiner*—Leslie A. Braun
*Assistant Examiner*—Anita M. King
*Attorney, Agent, or Firm*—Cohn, Powell & Hind

[57] ABSTRACT

This universal adaptor mounting bracket is used for mounting clocks to a wall panel. The bracket includes multiple mounting portions provided by offset bracket portions and/or slots, break away portions and auxiliary bracket portions suitable for mounting a variety of different clocks to the wall panel.

8 Claims, 4 Drawing Sheets

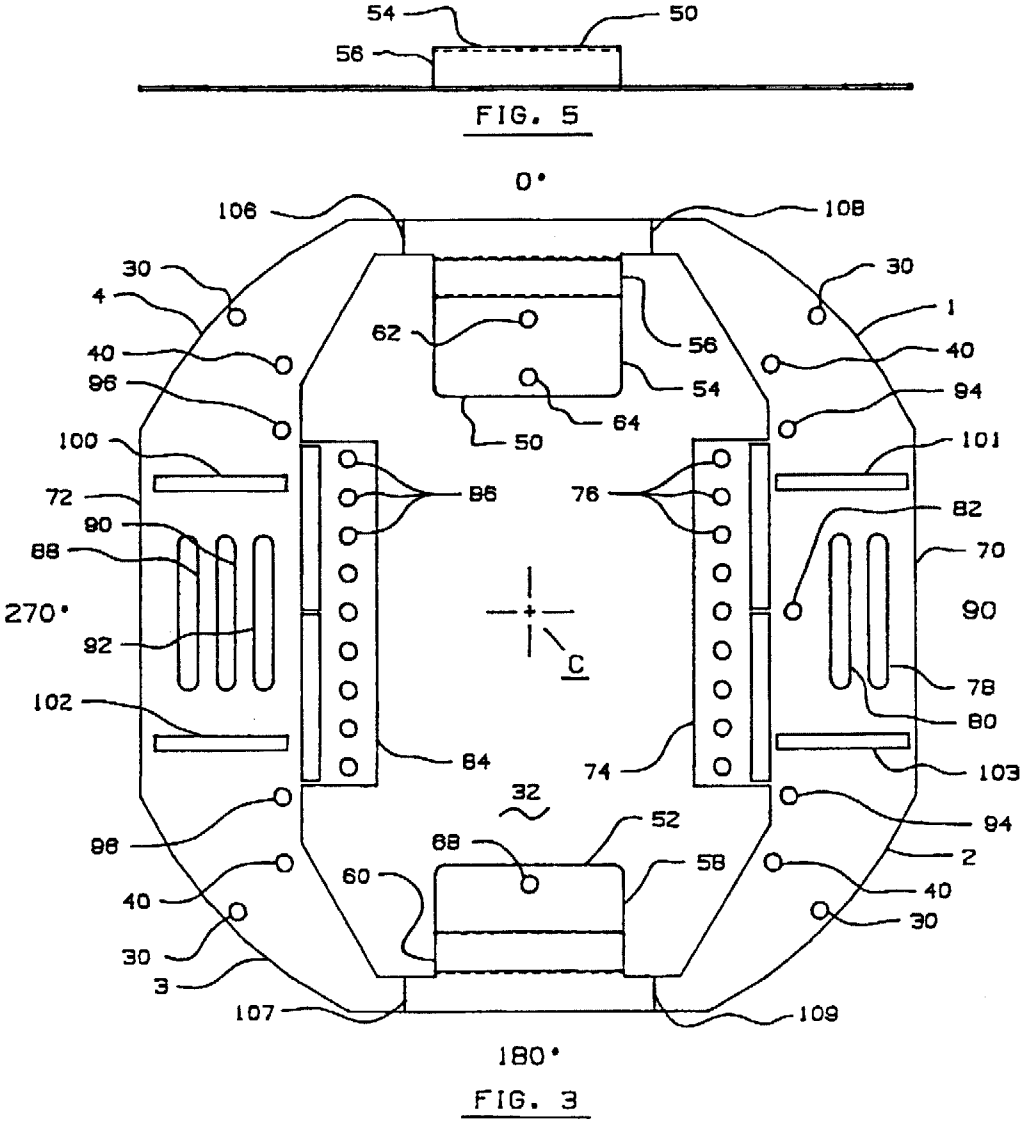
FIG. 5
FIG. 3
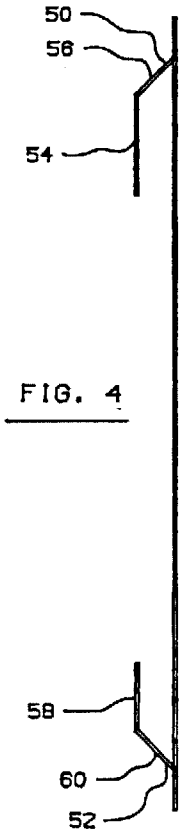
FIG. 4

454
94
1
4
3
10
2
452
450
420
414
92
88
90
350
320
314
111
250
220
214
52
68
150
160
114

ADAPTOR MOUNTING BRACKET FOR CLOCKS

BACKGROUND OF THE INVENTION

This invention relates generally to clock mounting brackets and particularly to a universal bracket which is adapted for mounting a variety of clocks to a wall panel.

Electric clocks are marketed by various manufacturers and each manufacturer provides an attachment for mounting the clock. Some manufacturers who make several clock models have different attachments for each clock.

Clocks of the type under consideration are often mounted to a wall panel or grill which is used in conjunction with a loudspeaker. The result of this arrangement is that the manufacturer of the loudspeaker and grill must provide a mounting bracket to suit a particular clock. This is a burden to the loudspeaker and grill manufacturer who must custom-make several different grills each adapted to suit a particular clock.

One problem with this procedure is that the grill manufacturer must accommodate a large number of clock manufacturers by welding onto the grill a particular type of bracket suitable for the clock in question. This means that a large number of different brackets must be available on special order. Another problem is that once a bracket has been welded to the grill, the end user loses the versatility of having a choice of clocks available to him.

There is a need in the market place for a mounting bracket which is substantially universal and can be used for a wide variety of clocks.

The present adaptor bracket solves this problem in a manner not revealed in the known prior art.

SUMMARY OF THE INVENTION

This universal clock mounting bracket provides a single bracket which can be attached to a grill to accommodate a large number of clocks manufactured by different manufacturers. The adaptor bracket can be attached complete, and rotated to the desired position to suit most available clocks. In addition, it can be separated into parts to suit most, if not all, of the remaining clocks currently available in the market place.

This invention provides a clock mounting system comprising a panel having an opening, an adaptor bracket having a first set of mounting portions, a second set of mounting portions and an opening generally aligned with said panel opening, said bracket being adapted to selectively receive a plurality of clocks in mounted relation, and attachment means mounting the bracket to the panel.

It is another aspect of this invention to provide that each set of mounting portions includes opposed mounting portions each having means mounting a selected clock.

It is an aspect of this invention to provide that said adaptor bracket is generally planar, having at least one mounting portion offset from the plane of the bracket to suit a selected clock.

It is another aspect of this invention to provide that at least one of said adaptor bracket mounting portions includes a break-away strap detachable from the bracket and re-attachable to a different part of the bracket, said strap having at least one attachment aperture adapted to suit a selected clock.

It is yet another aspect of this invention to provide that at least one of said mounting portions includes a plurality of slots each providing a mounting means for a selected clock.

It is another aspect of this invention to provide at least one cooperating auxiliary bracket connectable between a selected clock and one of said mounting means.

It is still another aspect of this invention to provide that the bracket can be separated into break-away components each providing a mounting means for a selected clock.

It is still another aspect of this invention to provide that said panel is a loudspeaker mounting panel.

This adaptor bracket is relatively simple and inexpensive to manufacture, easy to use and particularly effective for its intended purpose of mounting a wide variety of clocks to a wall-mounted panel.

BRIEF DESCRIPTION OF THE DRAWINGS:

FIG. 3 is an enlarged front elevational view of the adaptor bracket;

FIG. 4 is a plan view thereof;

FIG. 5 is a side view thereof;

FIG. 6 is an elevational view of the adaptor bracket of FIG. 3 rotated one hundred and eighty degrees;

Figure 2:
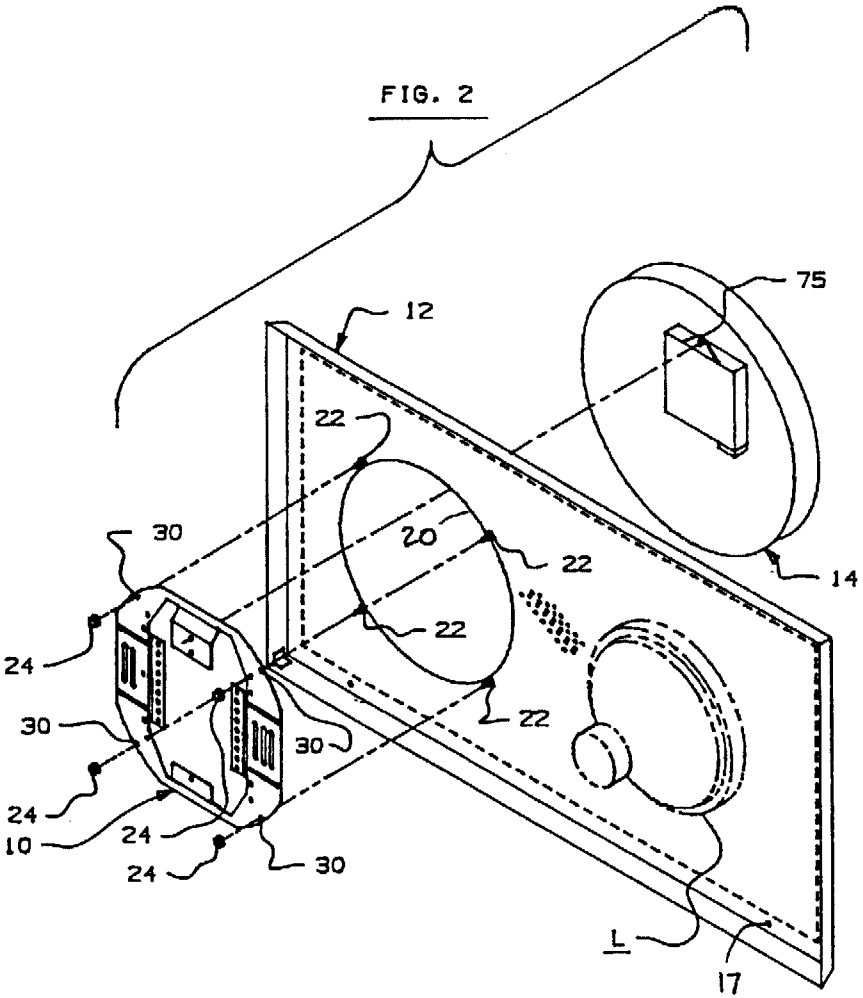
FIG. 2 is a rear perspective view of the system.
Figure 1:
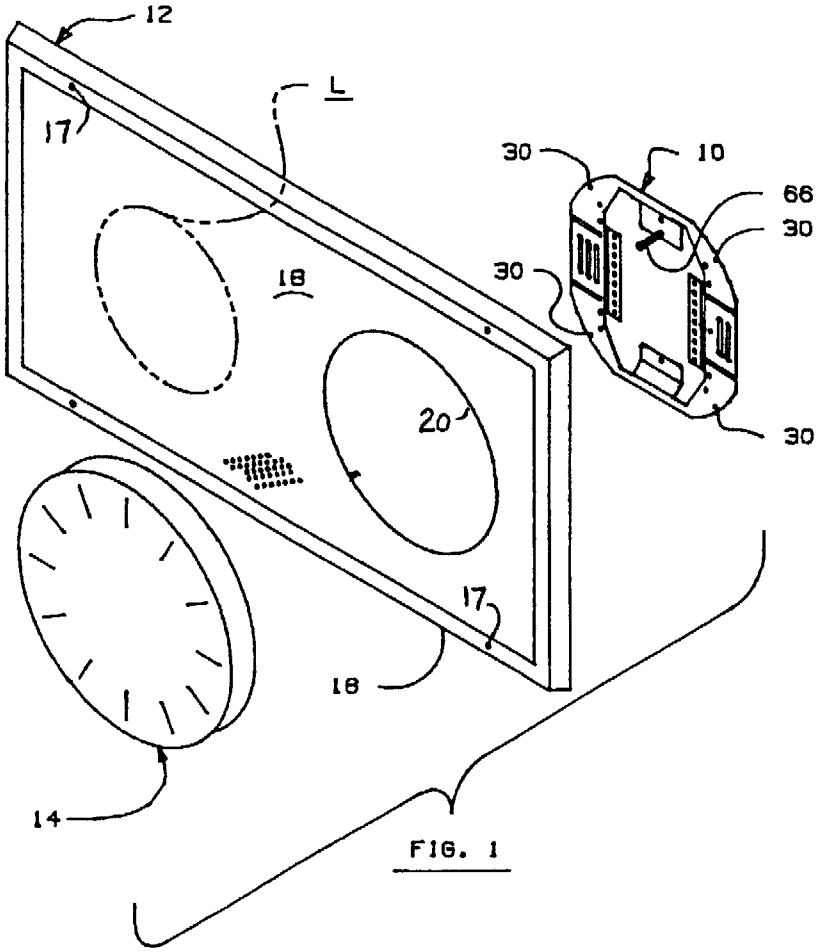
FIG. 1 is an exploded front perspective view of a typical clock mounting system utilizing the adaptor bracket.

DESCRIPTION OF THE PREFERRED EMBODIMENT:

Referring now by reference numerals to the drawings and first to FIGS. 1–6 it will be understood that the universal adaptor bracket 10 is used in conjunction with a baffle panel 12 to provide a mounting system for a clock 14. The baffle panel 12 is intended for use with a loudspeaker L shown in phantom outline in FIG. 2 and, in the embodiment shown, includes a generally rectangular frame 16 having a plurality of apertures 17 receiving wall mounting fasteners (not shown). The baffle panel 12 also includes a perforated grill 18, which is attached, as by welding, to the frame 16. The perforated grill 18 includes a circular opening 20. A plurality of studs 22, four in number in the embodiment shown, are arranged about the opening 20 and attached to the grill 18, as by welding. The studs 22 are in register with corresponding apertures 30, which are provided on the bracket 10 for attachment of the bracket to the grill. The bracket 10 includes an opening 32 and is attached to the grill 18, with the opening 32 generally aligned with the grill opening 20, as by nuts 24, shown in FIG. 2, at an orientation suitable for the selected clock 14. The studs 22 and apertures 30 are equally spaced on the same pitch circle.

In order to provide attachment for a plurality of selected clocks 14 the adaptor bracket 10 includes a variety of mounting points as will now be described by reference first to FIGS. 3–5.

The adaptor bracket 10 for many applications may be attached to the grill 18, in the embodiment shown, as a complete unit in any one of four rotational positions disposed at intervals of ninety degrees relative to each other. The rotational position shown in FIG. 3 may be regarded as the first position and corresponds to the position also shown in FIG. 1.

Preferably, the adaptor bracket 10 is unitarily formed from a blank of metal, such as steel, and includes inner and outer grill attachment apertures 30 and 40 in each quadrant 1, 2, 3 and 4. Outer apertures 30 are on the same diameter pitch circle and apertures 40 are on the same, but smaller diameter pitch circle. For the arrangement shown in FIG. 1 the apertures 30 are used to secure the adaptor bracket 10 to the grill 18. However, in some instances a smaller diameter opening 32 may be used, in which case the inner pitch circle apertures 40 may be used in lieu of apertures 30.

The adaptor bracket 10 includes a first set of opposed bracket portions 50 and 52. As shown in FIGS. 3–5, the bracket 10 is generally planar except for bracket portions 50 and 52. Bracket portion 50 includes offset portion 54 displaced in parallel spaced relation to the rest of the bracket and joined to it by an inclined portion 56. Bracket portion 52 likewise includes an offset portion 58 joined to the rest of the bracket by an inclined portion 60. Bracket portion 54 includes two apertures 62 and 64 each of which is arranged to receive a threaded shaft such as that indicated by numeral 66 in FIG. 1 which in turn is received by the apertured support lug 75 provided on the clock 14. Bracket portion 58 in the preferred embodiment includes a single aperture 68, which is arranged to receive the threaded shaft 66 when the complete bracket 10 is rotated through 180° so that bracket portion 52 is in the position formerly occupied by bracket 50. This arrangement, as clearly shown in FIG. 6, provides three available connection points, the radial distance of each of the apertures 62, 64 and 68 from the adaptor bracket center, indicated by C, being different. However, in the embodiment shown, the displacement of the portions 54 and 58 from the rest of the bracket is the same.

The adaptor bracket 10, in the embodiment shown, includes a second set of opposed bracket portions indicated by 70 and 72. Bracket portion 70 includes a break-away strap 74 having a plurality of apertures 76 which may be disposed at equally spaced intervals. In addition, bracket portion 70 includes two slots 78 and 80 and an aperture 82. Similarly, bracket portion 72, includes a break-away strap 84 having a plurality of apertures 86 which may be disposed at equally spaced intervals. In addition, bracket portion 72 includes three slots 88, 90 and 92.

Bracket portion 70 includes two apertures 94 on a centerline parallel to strap 74 and equally spaced perpendicularly from the 90°/270° axis passing through the center C. Bracket portion 72 also includes two apertures 96 on a centerline parallel to strap 84 spaced apart, perpendicularly from the 90°/270° axis passing through the center C the same distance as apertures 94. However, the distance of the centerline of apertures 94, measured perpendicularly from the 0°/180° axis passing through the center C, is different from that of apertures 96.

It will be understood from the above description of parts that the adaptor bracket is symmetrical with respect to the bracket mounting apertures 30 and 40. However, it is asymmetrical with respect to the spacing of the clock mounting apertures 62, 64 and the oppositely disposed clock mounting aperture 68, which respectively provide a first set of mounting means. It is also asymmetrical with respect to the spacing of the clock mounting slots 78 and 80 and aperture 82, and the oppositely disposed clock mounting slots 88, 90 and 92, which respectively provide a second set of mounting means.

Figure 7:
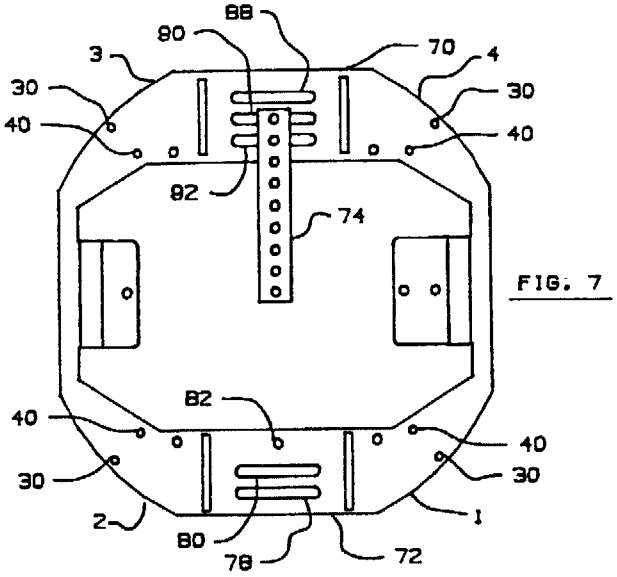
FIG. 7 is an elevational view of the adaptor bracket of FIG. 3 rotated ninety degrees and utilizing a break-away strap.

As shown in FIG. 7, the break-away straps 74 and 84 may be detached and connected, for example, to slots 90 and 92 to provide additional apertures for connection of additional selected clocks.

Figure 9:
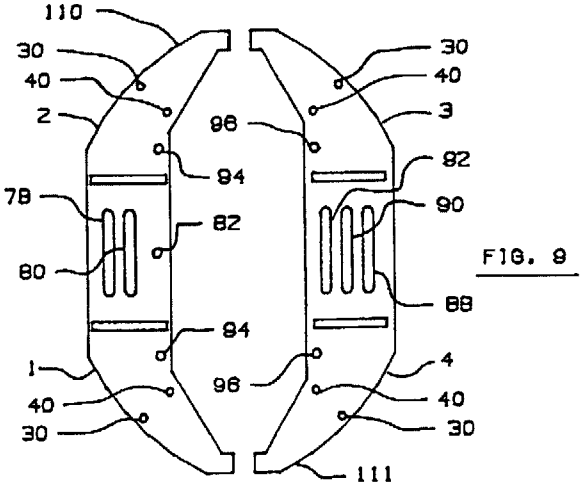
FIG. 9 is an elevational view of the adaptor bracket of FIG. 6 separated into two different component parts.
Figure 8:
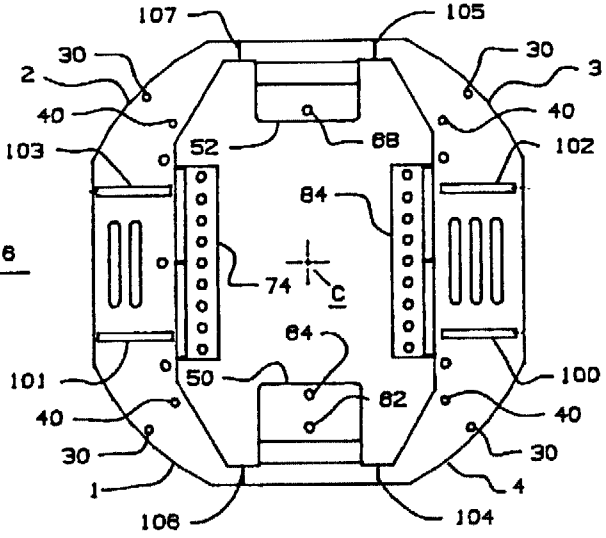
FIG. 8 is an elevational view of the adaptor bracket of FIG. 6 separated into two component parts.
Figure 8:
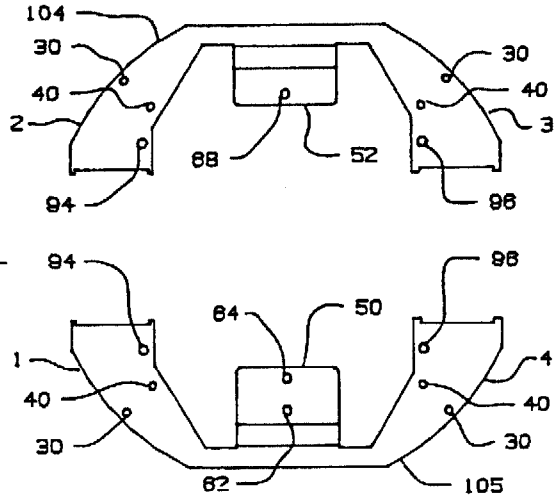

As discussed above, the adaptor bracket 10, in the embodiment shown, can be attached as a complete unit to the panel grill 18. Alternatively, it may be convenient in some instances to use and attach only a part of the bracket 10. To this end, as shown in FIG. 3 the adaptor bracket 10 may be provided with two sets break-away points. The first set of break-away points is provided by slots 100, 101, 102 and 103, which separate the adaptor bracket 10 into two sections 104 and 105 as shown in FIG. 8. The second set of break-away points is provided, as shown in FIG. 3, by grooves 106, 107 and 108, 109 which separate the adaptor bracket 10 into two sections 110 and 111, as shown in FIG. 9.

In the embodiment shown, the adaptor bracket 10 is formed from a square blank with arcuate corners to minimize visibility of the bracket relative to the clock which is usually of a circular configuration.

The adaptor bracket 10 may be used in conjunction with auxiliary brackets as shown in FIGS. 10–13.

Figures 10, 11, 12, 13:
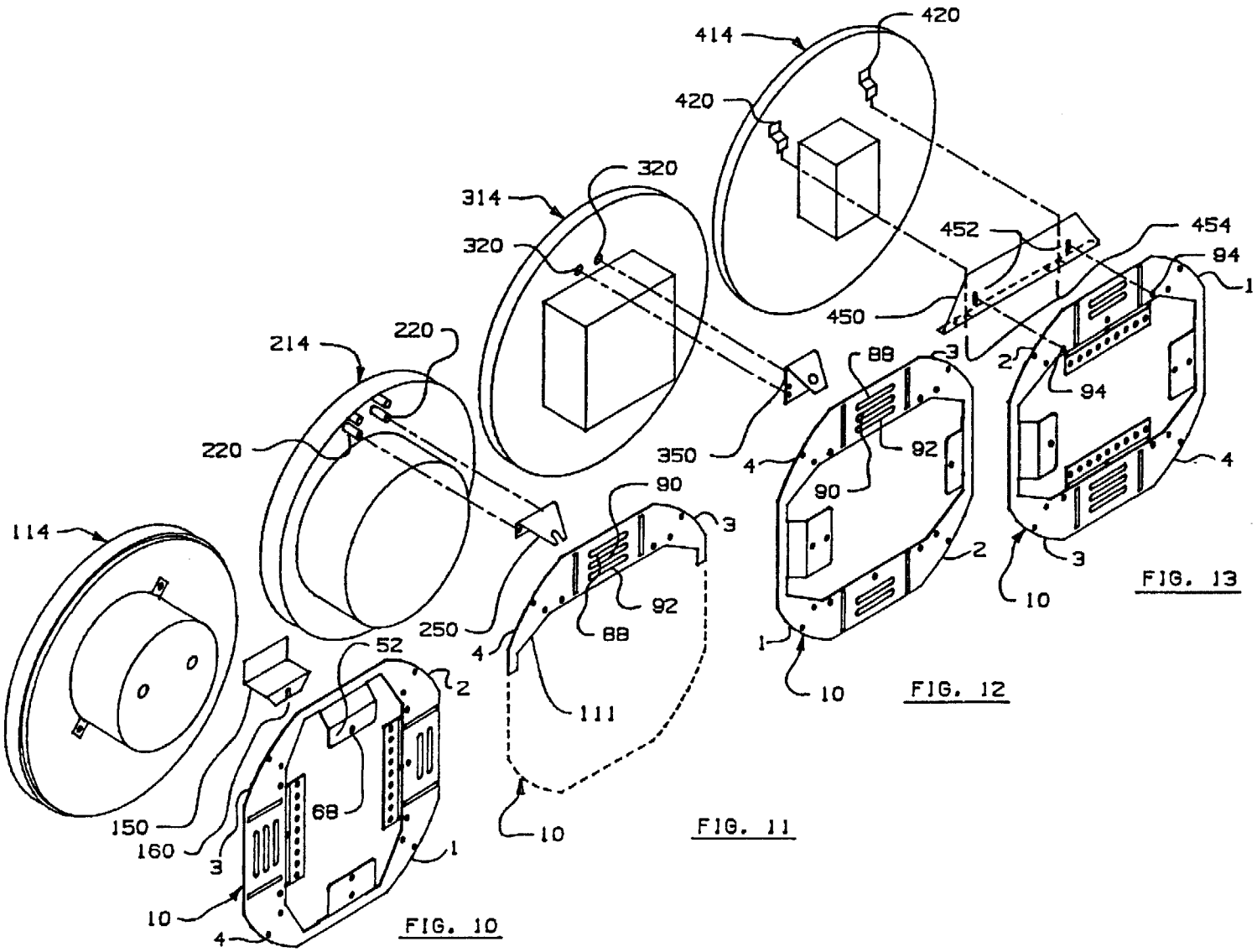
FIG. 10 is a perspective view of the adaptor bracket from the rear in one rotational mode, used in conjunction with a particular auxiliary bracket for a particular clock.
FIG. 11 is a perspective view of a component part of the adaptor bracket from the rear used in conjunction with a different auxiliary bracket for another clock.
FIG. 12 is a view similar to FIG. 10 with the adaptor bracket from the rear in another rotational mode and used in conjunction with a different auxiliary bracket for another clock.
FIG. 13 is a view similar to FIG. 10 with the adaptor bracket from the rear in another rotational mode and used in conjunction with a different auxiliary bracket for another clock.

FIG. 10 illustrates a clock 114 used in conjunction with adaptor bracket 10 attached to the grill 18 in a position rotated 180° from that shown in FIG. 3 viewed from the rear. The clock 114 is fitted with a cooperating auxiliary bracket 150 which is attached, as by adhesive, to the clock 114. The auxiliary bracket 150 is provided with a notch 160 which can readily be fitted over shaft 66 (not shown) attached to aperture 68.

FIG. 11 illustrates a clock 214 having threaded tubes 220 to which a cooperating auxiliary bracket 250 may be attached. In this arrangement, the adaptor bracket section 111, see FIG. 9, is used in conjunction with auxiliary bracket 250, which is bent at its front end to an oblique angle and fitted into an appropriate adaptor bracket slot 88, 90 or 92.

FIG. 12 illustrates a clock 314 having a pair of openings 320 to which a cooperating auxiliary bracket 350 can be attached as by fasteners (not shown). This arrangement is similar to that shown in FIG. 11 in that the auxiliary bracket front portion is bent to an oblique angle and fitted into an appropriate adaptor bracket slot 88, 90 or 92, except that the smaller size of the clock motor allows the complete bracket 10 to be used with the straps 74 and 84 removed.

FIG. 13, illustrates a clock 414 having a pair of lugs 420. In this arrangement, an elongate cooperating auxiliary bracket 450 is used, which includes slots 452, and is attached to the adaptor bracket apertures 94 by means of fasteners (not shown). Auxiliary bracket 450 also includes slots 454, into which the clock lugs 420 are hooked. In this arrangement, the complete bracket 10 may be used, rotated 90° from the position shown in FIG. 3.

Although the improved adaptor bracket has been described by making particular reference to a preferred construction, the details of description are not be understood as restrictive, numerous variants being possible within the principles disclosed and within the fair scope of the claims hereunto appended.

I claim as my invention:

1. A clock mounting system comprising:

(a) a panel having an opening, (b) an adaptor bracket having a first set of mounting portions, a second set of mounting portions and an opening generally aligned with said panel opening, said bracket being adapted to selectively receive a plurality of clocks in mounted relation, (c) attachment means mounting the bracket to the panel; and (d) at least one portion of one of said second set of mounting portions including a break-away strap detachable from the bracket and re-attachable to a different part of the bracket, said strap having at least one attachment aperture adapted to suit a selected clock.

2. A clock mounting system comprising:

(a) a panel having an opening, (b) an adaptor bracket having a first set of mounting portions, a second set of mounting portions and an opening generally aligned with said panel opening, said bracket being adapted to selectively receive a plurality of clocks in mounted relation, (c) attachment means mounting the bracket to the panel, and (d) at least one auxiliary bracket being provided to connect a selected clock to one of said mounting means.

3. A clock mounting system comprising:

(a) a panel having an opening, (b) a generally planar adaptor bracket having a first set of opposed mounting portions displaced from the plane of the bracket, each of said portions including means for mounting at least one selected clock and a second set of opposed mounting portions disposed in transverse relation to said first set of mounting portions, each mounting portion of said second set including at least one slot means for mounting a different selected clock, and (c) attachment means mounting the bracket to the panel.

4. A clock mounting system comprising as defined in claim 3, in which:

(a) a panel having an opening, (b) a generally planar adaptor bracket having a first set of opposed mounting portions displaced from the plane of the bracket, each of said portions including means for mounting at least one selected clock and a second set of opposed mounting portions disposed in transverse relation to said first set of mounting portions, each mounting portion of said second set including at least one slot means for mounting a selected clock, (c) attachment means mounting the bracket to the panel, and (d) said second set of opposed mounting portions each including a break-away strap detachable from the bracket and re-attachable to a different part of the bracket, each strap having at least one attachment aperture adapted to suit a different clock.

5. A clock mounting system as defined in claim 3, in which:

(e) said panel is a loudspeaker mounting panel.

6. A clock mounting system comprising:

(a) a panel having an opening, (b) an adaptor bracket having a first set of mounting portions, a second set of mounting portions and an opening generally aligned with said panel opening, (c) said bracket having first opposed break-away means permitting part of said bracket, including at least one set of mounting portions, to be removed from said bracket as a whole and mounted separately to said panel, and (d) attachment means mounting the bracket to said panel.

7. A clock mounting system as defined in claim 6, in which:

(e) said bracket includes second opposed break-away means permitting a different part of said bracket to be removed from said bracket as a whole and mounted separately to said panel.

8. A clock mounting system as defined in claim 6, in which:

(e) said panel is a loudspeaker mounting panel.

* * * * *